US006684420B2

(12) United States Patent
Koenig et al.

(10) Patent No.: US 6,684,420 B2
(45) Date of Patent: Feb. 3, 2004

(54) CRIB APPARATUS

(75) Inventors: John W. Koenig, Cincinnati, OH (US); Gregory W. Branson, Batesville, IN (US); William L. Jacques, II, Batesville, OH (US); Diana W. Juratovac, Columbus, OH (US); Kenneth L. Kramer, Greensberg, IN (US); Robert Mark LeBlanc, Rockford, MI (US); Peter A. Koloski, Columbus, OH (US); Thornton K. Lothrop, Worthington, OH (US); Kristin R. Romak, West Chester, OH (US); John E. Sagel, Columbus, OH (US); Rainer B. Teufel, Columbus, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/843,899

(22) Filed: Apr. 27, 2001

(65) Prior Publication Data

US 2002/0157180 A1 Oct. 31, 2002

(51) Int. Cl.[7] ..... A47D 7/02
(52) U.S. Cl. ..... 5/93.1; 5/100
(58) Field of Search ..... 5/93.1, 97, 100, 5/424, 425, 507.1

(56) References Cited

U.S. PATENT DOCUMENTS

| | | | | |
|---|---|---|---|---|
| 192,467 A | | 6/1877 | Stevens | |
| 357,088 A | | 2/1887 | McGrath | |
| 388,191 A | | 8/1888 | Furl et al. | |
| 565,047 A | | 8/1896 | Tardis | |
| 754,140 A | | 3/1904 | Hollis | |
| 785,099 A | | 3/1905 | Herbener | |
| 824,488 A | | 6/1906 | Koenig et al. | |
| 1,107,918 A | | 8/1914 | Dimmerling | |
| 1,112,567 A | | 10/1914 | Sekrit | |
| 1,242,545 A | | 10/1917 | Hanger | |
| 1,279,064 A | | 9/1918 | Swingle | |
| 1,299,366 A | | 4/1919 | McLaren | |
| 1,321,905 A | | 11/1919 | Gannon | |
| 1,322,616 A | | 11/1919 | Rece | |
| 1,347,393 A | | 7/1920 | McCreary | |
| 1,568,419 A | | 1/1926 | Rossborough | |
| 1,594,256 A | | 7/1926 | Greene | |
| 1,618,447 A | | 2/1927 | Kusterle | |
| 1,649,754 A | | 11/1927 | Summerson | |
| 1,847,916 A | | 3/1932 | Beaman | |
| 2,253,824 A | | 8/1941 | Townsend et al. | |
| 2,402,286 A | * | 6/1946 | Jeary | 5/100 |
| 2,392,948 A | | 11/1946 | Reeves | |
| 2,442,048 A | | 5/1948 | Kroll et al. | |
| 2,555,032 A | | 5/1951 | Hall | |
| 2,583,858 A | | 1/1952 | Kostolecki | |
| 2,590,337 A | | 3/1952 | McNabb et al. | |
| 2,592,166 A | | 4/1952 | McLean et al. | |
| 2,673,989 A | | 4/1954 | Veitch | |
| 2,689,960 A | | 9/1954 | Lax | |
| 2,733,455 A | * | 2/1956 | Stuart et al. | 5/507.1 |
| 2,827,641 A | | 3/1958 | Reichert et al. | |

(List continued on next page.)

FOREIGN PATENT DOCUMENTS

DE 296 13 571 U1 12/1996

*Primary Examiner*—Teri Pham Luu
*Assistant Examiner*—Frederick Conley
(74) *Attorney, Agent, or Firm*—Barnes & Thornburg

(57) ABSTRACT

A combination crib and high chair apparatus for supporting a child in a reclining position, and a seated position, respectively. The apparatus includes a deck having a head end, a foot end and generally parallel sides. Side rails are positioned adjacent the sides. End rail are positioned adjacent the ends of the deck. A seat is oriented adjacent one of the ends of the deck. The seat extends outwardly from the end. A base is coupled to the deck and the seat.

41 Claims, 5 Drawing Sheets

U.S. PATENT DOCUMENTS 2,870,460 A 1/1959 Sanford
2,913,737 A 11/1959 McNabb
3,026,543 A 3/1962 McPhaden
3,032,154 A 5/1962 McNabb
3,051,270 A 8/1962 Burzlaff
3,055,042 A 9/1962 Burzlaff
3,063,066 A 11/1962 Peck et al.
3,069,700 A 12/1962 Berlin
3,093,838 A 6/1963 Beasley
3,111,332 A 11/1963 Birch
3,305,876 A 2/1967 Hutt
3,335,713 A 8/1967 Grosholz et al.
3,336,608 A 8/1967 Lerner
3,344,442 A 10/1967 Andrews et al.
3,529,590 A 9/1970 Grosholz
3,634,894 A 1/1972 Harbison
3,638,247 A 2/1972 Kennedy
3,648,307 A 3/1972 Meade
3,654,645 A 4/1972 Lee
3,686,696 A * 8/1972 Lanigan ..... 5/611
3,763,507 A 10/1973 Propst
3,780,387 A 12/1973 Propst
3,797,053 A 3/1974 Mamo
3,800,341 A 4/1974 Davanzo
3,833,947 A 9/1974 Sorensen
3,848,278 A 11/1974 Propst
3,911,525 A 10/1975 Haussels
3,921,233 A * 11/1975 Mann ..... 5/100
3,971,079 A 7/1976 Fleischer
4,017,917 A 4/1977 Brown
4,043,349 A 8/1977 Gays et al.
4,139,917 A 2/1979 Fenwick
4,285,079 A 8/1981 Hillman
4,336,621 A 6/1982 Schwartz et al.
4,359,792 A 11/1982 Dale
4,403,357 A 9/1983 Degen
4,525,883 A 7/1985 Necowitz
4,633,539 A 1/1987 Morrison
4,670,923 A 6/1987 Gabriel et al.
4,768,242 A * 9/1988 LoTurco ..... 5/93.1
4,787,104 A 11/1988 Grantham
4,854,913 A * 8/1989 Kelley et al. ..... 446/227
4,882,799 A 11/1989 Shapiro
4,937,902 A 7/1990 Ceike Shapiro
4,944,055 A 7/1990 Shainfeld
4,979,246 A 12/1990 Godin et al.
4,998,320 A 3/1991 Lange
5,014,391 A 5/1991 Schulte
5,067,183 A 11/1991 Urquiola
5,115,539 A 5/1992 Lee
5,149,036 A 9/1992 Sheehan
5,230,523 A * 7/1993 Wilhelm ..... 280/30
5,242,375 A 9/1993 McDonough
5,291,623 A 3/1994 Artz
5,303,450 A 4/1994 Lange
5,329,657 A 7/1994 Bartley et al.
5,330,415 A 7/1994 Storti et al.
5,377,372 A 1/1995 Rudolf et al.
5,379,469 A 1/1995 Millis et al.
5,453,077 A 9/1995 Donnelly et al.
5,535,457 A 7/1996 Welsh et al.
5,537,701 A 7/1996 Elliott
5,553,337 A 9/1996 Lin
5,579,550 A 12/1996 Bathrick et al.
5,604,941 A 2/1997 Roman
5,634,796 A 6/1997 Dollar
5,742,959 A 4/1998 Froelich
5,802,634 A 9/1998 Onishi et al.
5,862,548 A 1/1999 Gerhart
5,882,208 A 3/1999 Fulop
5,899,469 A 5/1999 Pinto et al.
6,089,654 A * 7/2000 Burstein ..... 297/151
6,339,855 B1 * 1/2002 Socha et al. ..... 5/424

* cited by examiner

CRIB APPARATUS

FIELD OF THE INVENTION

The present invention relates to a crib apparatus and particularly, to a crib apparatus for supporting infants and toddlers during their stays at a hospital. More particularly, this invention relates to a crib apparatus having chair and bed portions.

BACKGROUND OF THE INVENTION

Adult hospital patients typically are provided with hospital beds adjustable to sitting positions, for example, to facilitate serving of meals to the patients. Meals are generally served to such a patient on an overbed table placed adjacent to the patient's bed so that the overbed table is oriented over the patient's lap when the bed is oriented so that the patient is sitting up. After the meal, the overbed table is moved away from the bed and stored elsewhere.

Infants are generally fed while being held by an adult. However, children between the ages of, for example, 9 months and 4 years, are generally too large to be fed in the arms of an attending health care worker or parent, but are too young to be fed using an overbed table. Such children might eat sitting in conventional high chairs or booster seats when at home. However, such equipment may not be available in a hospital.

Furthermore, health care workers who attend to children at hospitals often stand beside the child's crib. Attending health care workers thus prefer for the child to be supported at a relatively high elevation to facilitate access to the child. On the other hand, a parent of a hospitalized child may spend considerable time seated in a chair at the child's bedside. For this reason, parents may prefer for the child to be supported at a relatively low elevation to facilitate access to the child.

Thus, a child's bed that is adjustable through a wide range of elevations and includes an integrated high chair would be appreciated by health care workers and parents. Health care workers and parents would also appreciate a child's bed having rails that are movable to positions permitting unobstructed access to the child. In addition, health care workers and parents would appreciate a child's bed that permits the child to be moved into and out of the bed without the need to disconnect and reconnect any tubes or wires that are coupled to the child, for example, for the administration of health care.

SUMMARY OF THE INVENTION

Accordingly, an embodiment of the present invention includes a mattress and a crib structure configured to support the mattress. The crib structure includes a chair portion, a tray movable relative to the chair portion, and a crib rail assembly movable relative to the mattress and relative to the chair portion. In preferred embodiments, the tray moves horizontally relative to the chair portion, and the crib rail assembly moves vertically relative to the chair portion. Some embodiments include a powered drive assembly that is operable to change the position of the mattress relative to the chair portion. According to one embodiment, the crib structure includes a first end unit having a chair portion and a second end unit having a storage compartment.

In an illustrative embodiment the crib structure includes a chair portion having an upwardly-facing seat surface and a back surface extending above the seat surface and terminating at a top edge. In this embodiment, the crib structure further includes a tray movable between a first position covering the seat surface and covering the top edge and a second position uncovering at least a portion of the seat surface.

In accordance with the illustrative embodiment, an apparatus includes a mattress having a periphery and an upwardly-facing surface. The apparatus includes a crib structure configured to support the mattress. The crib structure has a pair of spaced apart end units, each of which has a top surface. The crib structure also has a plurality of crib rail assemblies positioned about the periphery of the mattress. The crib rail assemblies are movable vertically relative to the mattress and each of the crib rail assemblies has a top rail edge. The mattress and crib rail assemblies are movable to a position in which the top surfaces of the end units, the top edges of the crib rail assemblies, and the upwardly-facing surface of the mattress are substantially coplanar.

Also in accordance with the illustrative embodiment, the crib structure includes a plurality of crib rail assemblies each having a pair of spaced apart side edges. The crib rail assemblies are movable vertically relative to the mattress between raised and lowered positions. Each crib rail assembly is movable independent of each of the other crib rail assemblies. A plurality of gaps are defined between the side edges of the crib rails when the crib rails are in the raised position. The gaps are configured to permit passage of medical lines therethrough.

Additional features and advantages of this apparatus will become apparent to those skilled in the art upon consideration of the following detailed description of the illustrated embodiment exemplifying the best mode of carrying out the apparatus as presently perceived.

BRIEF DESCRIPTION OF THE DRAWINGS

The invention may best be understood by referring to the following detailed description and accompanying drawings which illustrate the invention. In the drawings:

FIG. 9 is a top plan view of the portion of the patient support of FIG. 8 showing the tray moved to an outermost position having the seat surface completely uncovered;

FIG. 10 is a sectional view taken along line 10—10 of FIG. 9 showing a crotch post appended to an undersurface of the tray and extending downwardly therefrom;

FIG. 11 is an end elevational view of the apparatus illustrated in FIGS. 1–10 in the orientation illustrated in FIGS. 1 and 6;

FIG. 12 is an end elevation view similar to FIG. 11 showing a canopy assembly supported above the crib rail assemblies;

FIG. 13 is a partial sectional view of the patient support of FIG. 12 showing a top canopy segment, a first canopy segment moved about a longitudinal axis to an opened position having an arcuate panel of the first canopy segment positioned to lie in an interior region of the top canopy segment, and a second canopy segment in a closed position having the majority of an arcuate panel of the second canopy segment positioned to lie outside the interior region of the top canopy segment;

FIG. 14 is a partial sectional view similar to FIG. 13 showing the first canopy segment in a closed position having a majority of the arcuate panel of the first segment positioned to lie outside the interior region of the top canopy segment and showing the second canopy segment moved to an opened position having the arcuate panel of the second canopy segment positioned to lie in the interior region of the top canopy segment;

FIG. 15 is a partial sectional view similar to FIG. 13 of an alternative embodiment canopy assembly showing a first canopy half moved about a longitudinal axis partially toward an open position and a second canopy half in a closed position, the first canopy half having an arcuate panel that overlies an arcuate panel of the second canopy half when the first canopy half is in the open position; and FIG. 16 is a top plan view of the patient support of FIG. 1.

Corresponding reference characters indicate corresponding parts throughout the several views. The exemplification set out herein illustrates an embodiment of the apparatus, in one form, and such exemplification is not to be construed as limiting the scope of the apparatus in any manner.

DETAILED DESCRIPTION OF THE DRAWINGS

Figure 1:
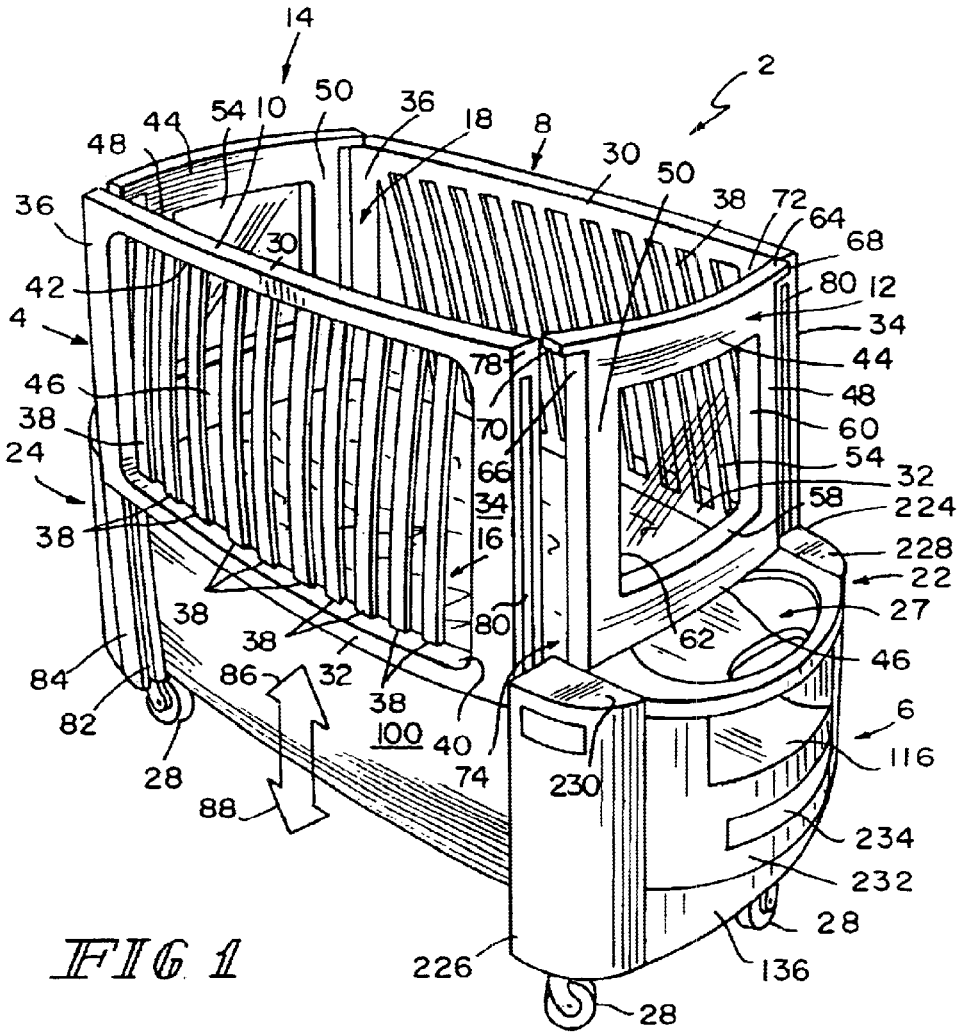
FIG. 1 is a perspective view of a patient support according to the present invention showing a mattress, a crib structure supporting the mattress, and the crib structure having a plurality of crib rail assemblies, each crib rail assembly being in a raised position above the mattress.

In the illustrated embodiment, a patient support or crib apparatus 2 includes a mattress 16 and a crib structure 4 configured to support mattress 16 as shown in FIGS. 1–6. Crib structure 4 includes a plurality of crib rail assemblies 8, 10, 12, 14 two of which are longitudinally extending side rails assemblies 8, 10 and two of which are transversely extending end rail assemblies 12, 14. Thus, rail assemblies 8, 10 extend along the long sides of mattress 16 and end rail assemblies extend along the short sides of mattress 16. Crib structure 4 also includes a base 20 having a central portion 100 underlying mattress 16 and a pair of end units or sections 22, 24 coupled to central portion 100 at opposite ends thereof as shown best in FIGS. 4 and 6. (See FIG. 4.) A power drive assembly 101 which may, for example, include electrical, hydraulic and/or pneumatic prime mover components, is provided in central portion 100. Power drive assembly 101 is used to change, inter alia, the position of mattress 16. A plurality of casters 28 are coupled to base 20 as shown in FIG. 1.

Figure 8:
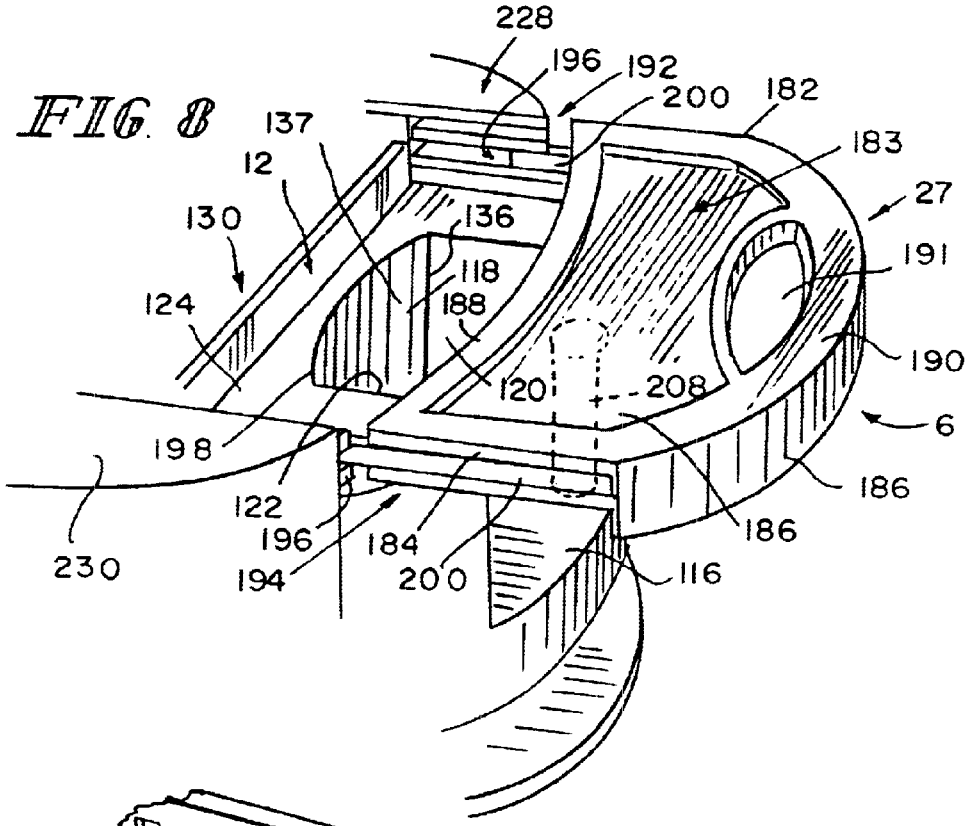
FIG. 8 is a perspective view of a portion of the patient support of FIG. 1 showing the crib structure having a chair portion with an upwardly facing seat surface and a back surface extending above the seat surface and showing a tray of the crib structure moved to a position uncovering a portion of the seat surface.

Crib structure 4 includes a high chair portion 6 and a tray 27 as shown in FIGS. 8 and 10. Patient support apparatus 2 is useful for children. Those too young or whose condition is too critical to feed themselves will remain on mattress 16 and will receive their meals, for example, intravenously or from a bottle. Children capable of doing so can take their meals sitting on chair portion 6, with their food placed on tray 27. Children capable of doing so can also sit on chair portion 6 and play with toys placed on tray 27. Inclusion of chair portion 6 and tray 27 as part of patient support apparatus 2 thus can reduce the amount of equipment a health care facility needs to purchase, maintain and store for these functions.

Crib rail assemblies 8, 10, 12, 14 and mattress 16 are vertically adjustable through a wide range of elevations. For example, mattress 16 is continuously adjustable from a high position illustrated in FIGS. 1 and 3 to a low position illustrated in FIG. 5. When mattress 16 is in the position illustrated in FIGS. 1 and 3, crib rail assemblies 8, 10, 12, 14 are movable independently of each other between the positions illustrated in FIGS. 1 and 6 and the positions illustrated in FIGS. 3 and 4. When mattress 16 is in the position illustrated in FIG. 5, side rails 8, 10 are further movable to the positions illustrated in FIG. 5. Typically, when caregivers desire unobstructed access to the patient, crib rail assemblies 8, 10, 12, 14 are moved to the lowered position, but mattress 16 is left in the high position because the caregivers attending to the patient will usually be standing alongside patient support apparatus 2. Parents and other visitors, on the other hand, may prefer to have mattress 16 and side rails 8, 10 in even lower positions to promote visibility of and access to the patient when the parents and/or visitors are seated near the patient support apparatus 2.

Figure 2:
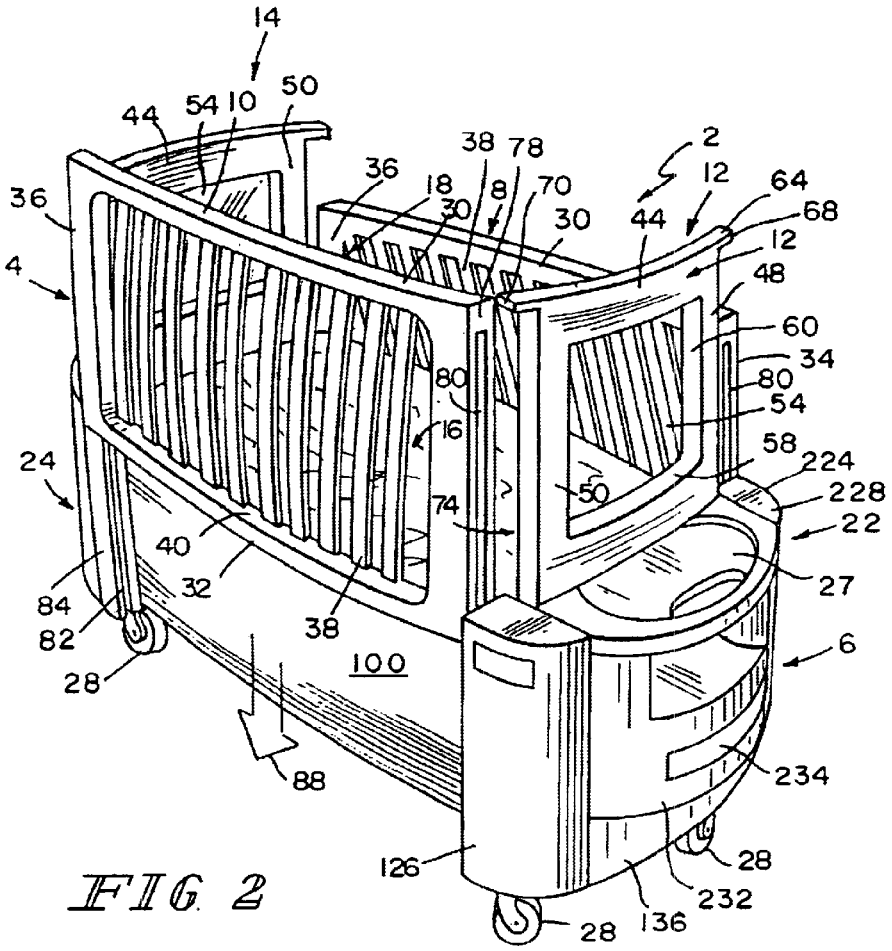
FIG. 2 is a perspective view of the patient support of FIG. 1 showing each of the crib rail assemblies being movable independently of one another and lowered by different amounts from the respective raised positions.

Each crib side rail assembly 8, 10 includes a top 30, a bottom 32, and sides 34, 36. In addition, each crib rail assembly 8, 10 is movable independently of each of end crib rail assemblies 12, 14, as shown in FIG. 2 where each of crib rail assemblies 8, 10, 12, 14 are in different positions between their respective raised and lowered positions. Crib apparatus 2 is provided with suitable locking mechanisms that lock each of crib rail assemblies 8, 10, 12, 14 in their respective adjusted positions. Such locking mechanisms are well-known to those skilled in the art to which this invention pertains. For example, in one embodiment, sides 34, 36 of each crib rail assembly 8, 10 include a plurality of apertures that receive corresponding locking pins (not shown) that extend out of end units 22, 24. The locking pins are retracted out of the apertures by actuation of suitable release mechanisms such as handles, levers, knobs, buttons, or the like that are operatively coupled to the locking pins either mechanically via cables, chains, links, and the like or electrically via solenoids, motors, relays, and the like. Equivalents to the locking pins include, but are by no means limited to, latches, hooks, pawls, or the like.

Figure 3:
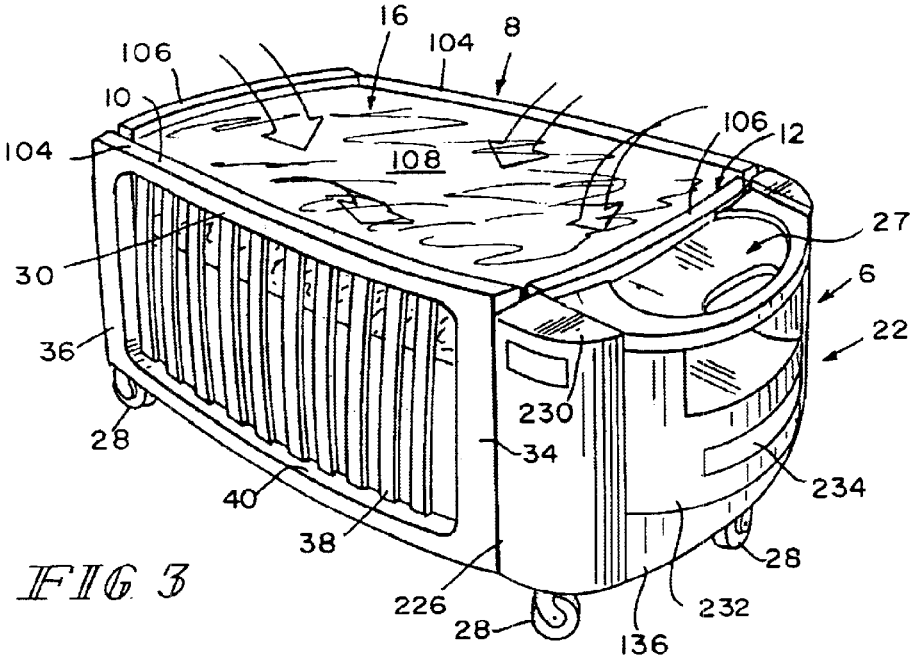
FIG. 3 is a perspective view of the patient support of FIG. 1 showing each crib rail assembly moved to a lowered position having respective top edges of the crib rail assemblies substantially coplanar with an upwardly facing surface of the mattress.
Figure 4:
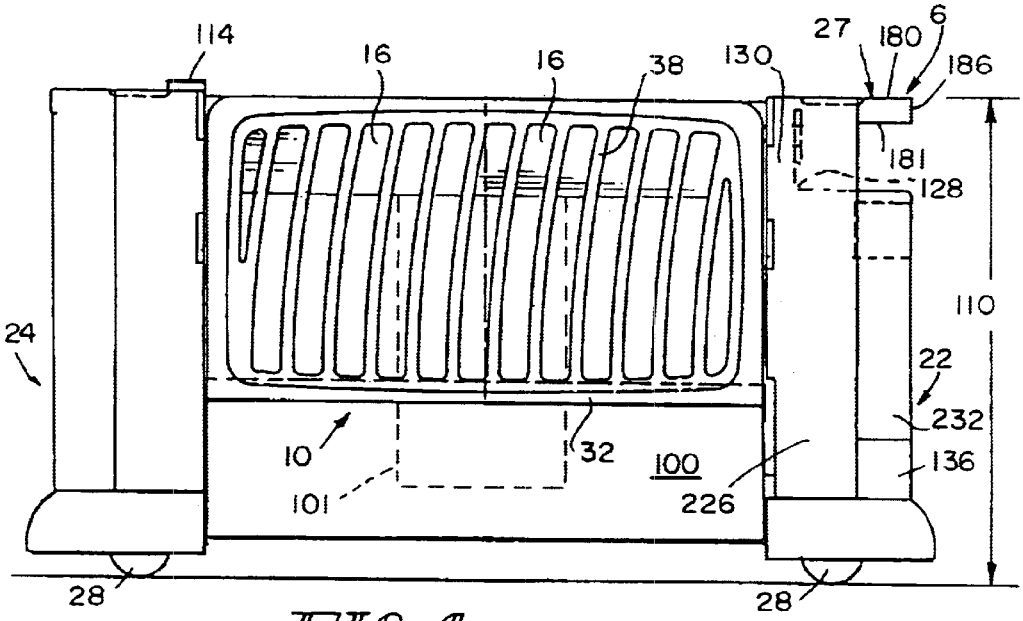
FIG. 4 is a side elevation view of the patient support of FIG. 3 showing the substantially coplanar relationship of the upwardly facing surface of the mattress, the top edges of the crib rail assemblies, and the top surfaces of a pair of end units located adjacent to opposite ends of the mattress.
Figure 5:
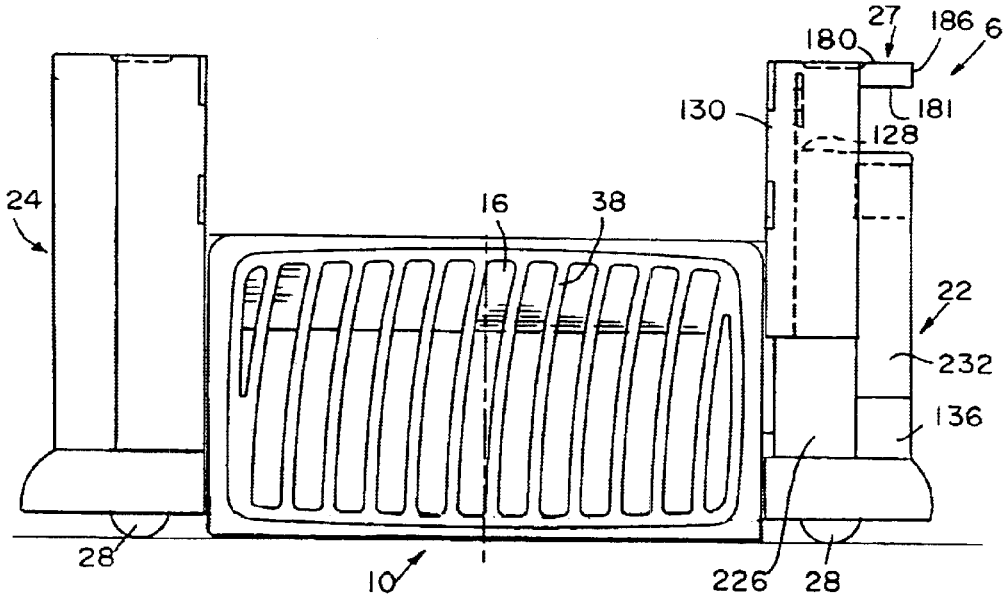
FIG. 5 is a side elevation view similar to FIG. 4 showing the mattress and two of the crib rail assemblies along the sides of the mattress moved to a position below the top surfaces of the end units.
Figure 6:
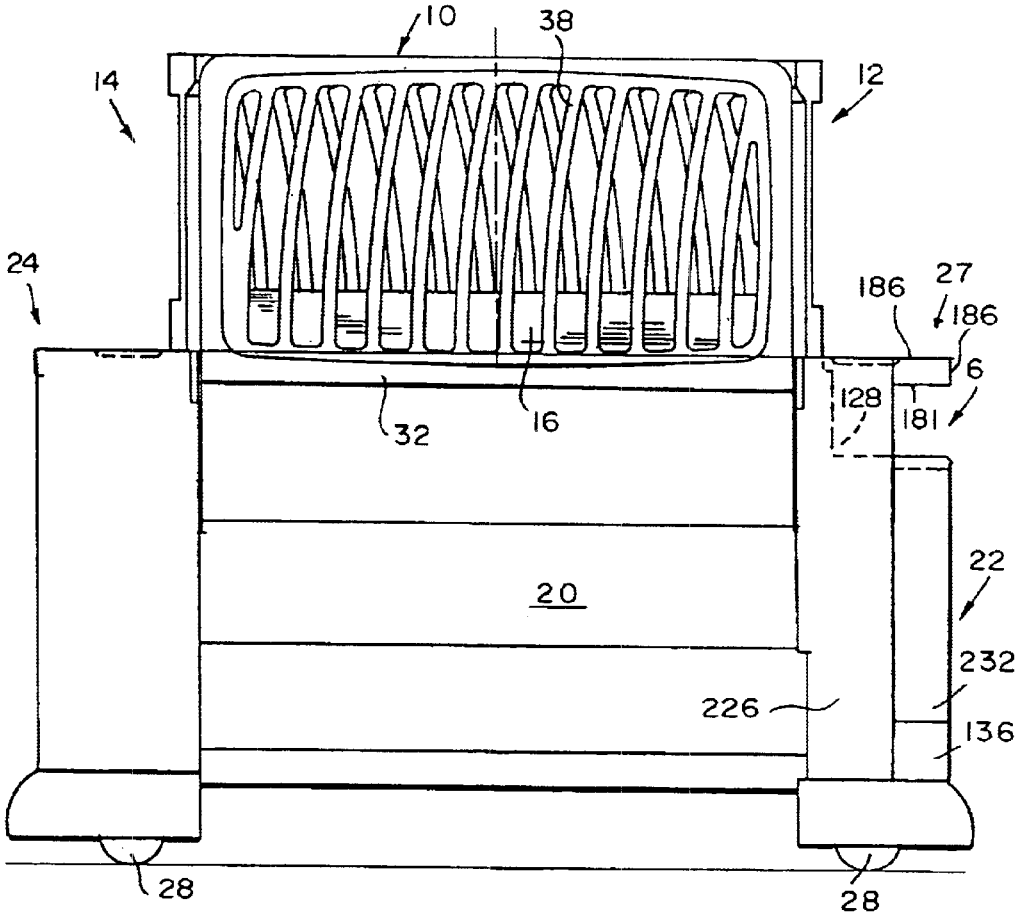
FIG. 6 is a side elevation view of the patient support of FIG. 1 showing the crib rail assemblies in the raised position.

In cases in which optimum access to the patient is necessary or desirable, all of the locking mechanisms are unlocked and all rail assemblies 8, 10, 12, 14 are moved to the positions illustrated in FIG. 3. In the illustrated embodiment, assemblies 8, 10, 12, 14, are lowered to place portions 30, 44 at or below surface 108 of mattress 16. The access to the patient afforded the caregiver standing anywhere about patient support apparatus 2 can best be appreciated by comparing FIGS. 3 and 4 to FIG. 1. Height 110 illustrated in FIG. 4 is convenient for the caregiver working with the patient.

Figure 7:
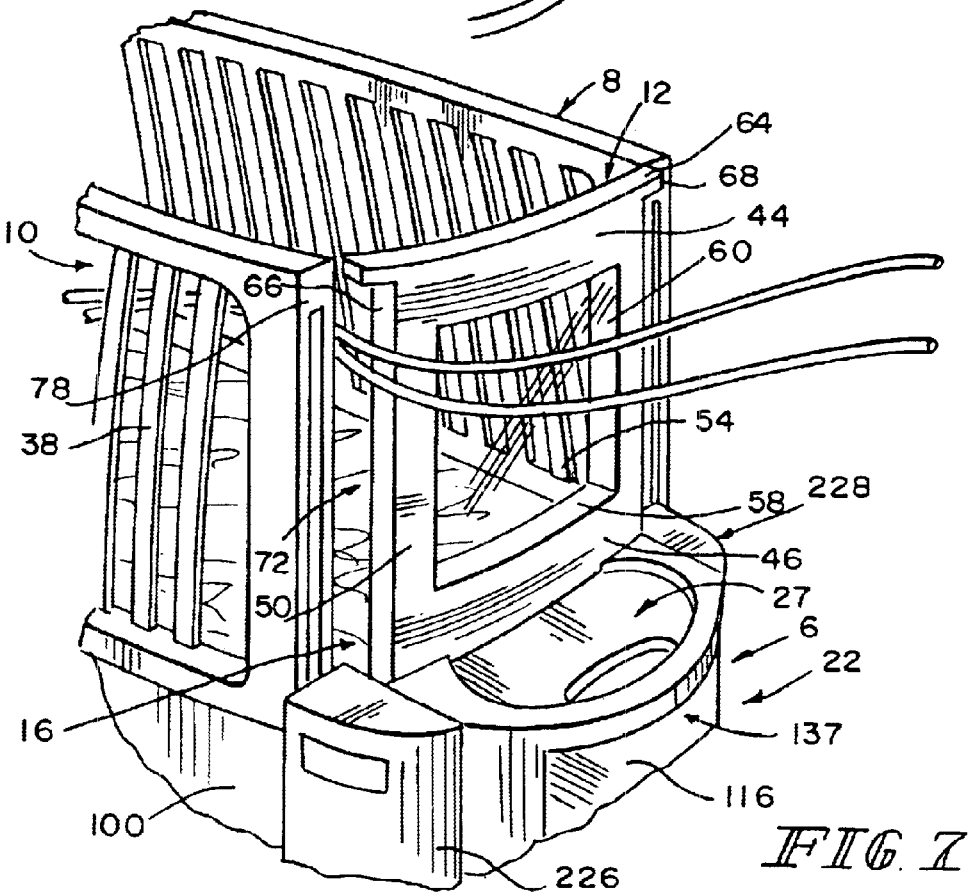
FIG. 7 is a perspective view of a portion of the patient support of FIG. 1 showing medical lines passing through a gap defined between side edges of two of the crib rail assemblies.

Various medical lines, such as intravenous tubes, oxygen tubes, waste management tubes, electrocardiograph wires, electroencephalograph wires, and the like oftentimes extend between the patient and associated medical equipment. Crib rail assemblies 8, 10, 12, 14 of patient support apparatus 2 are configured to permit such medical lines, for example lines 23 shown in FIG. 7, to extend through passageways 74 located at the corner regions between siderails 8, 10 and end rails 12, 14.

FIG. 1 illustrates a support apparatus 2 with integral crib structure 4 and high chair portion 6. High chair portion 6 is formed in end section 22. High chair portion 6 includes a seat 26 and a tray 27. As is conventional, each side rail assembly 8, 10 includes several bars 38 which extend generally vertically between an upper surface 40 of bottom portion 32 and a lower surface 42 of upper portion 30.

End rail assemblies 12, 14, include spaced apart top and bottom portions 44, 46, respectively, and spaced apart side portions 48, 50, respectively. Portions 44, 46, 48, 50 cooperate to form a frame. A clear panel 54 mounted to the inner surfaces 56, 58, 60, 62, of portions 44, 46, 50, 52 permits observation of the patient on mattress 16. Panel 54 can be made from, for example, a transparent or suitably translucent resin. Decorative indicia, such as stickers, are optionally included on panel 54.

Flanges 64, 66, extend outwardly from top portions 44 of ends 68, 70 adjacent ends 72 of side rail assemblies 8, 10 to form passageways 74 between end surfaces 76 of end rail assemblies 12, 14, and end surfaces 78 of side rail assemblies 8, 10. Passageways 74 are provided at each corner of crib structure 4 to accommodate lines 23 as previously discussed.

As previously discussed, rail assemblies 8, 10, 12, 14, are movable relative to mattress 16. In the illustrated embodiment, a groove 80 is provided in each end surface 76. A tongue 82 is provided on a surface 84 of each end section 22, 24 to engage each groove 80 to provide for the vertical movement of rail assemblies 8, 10 relative to end sections 22, 24. This movement is indicated by directional arrows 86, 88. The range of motion can be appreciated by referring to FIGS. 4, 5 and 6. End rails 12, 14 are similarly movable vertically with respect to their respective end sections 22, 24.

End sections 22, 24 include side panels 224, 226 and top panels 228, 230. As illustrated in FIG. 8, sides 182, 184 lie adjacent top panels 228, 230. Sides 182, 184, form portions of rail assemblies 192, 194, respectively, which will be discussed in greater detail below. As best illustrated in FIG. 1, surfaces 84 having tongues 82 extend inwardly from panels 224, 226.

A face panel 232 extends outwardly between side panels 224, 226. In the illustrated embodiment, end section 22 includes a storage compartment 234 which is accessible through an opening provided in face panel 232. See FIGS. 1 through 3. Another face plate 236 is positioned between side panels 224, 226 below face panel 232.

End section 24 is similar in construction to end section 22. In the illustrated embodiment, end section 24 does not include high chair portion 6 or storage compartment 234. However, end section 24 could include one or the other or both a storage compartment and/or a high chair if desired.

Referring now particularly to FIG. 8, high chair portion 6 includes seat 26 having a generally horizontally extending seat surface 116, a generally vertically extending, illustratively curved, back rest 118, generally vertically extending sides 120, 122, a top surface 124, and tray 27. Seat 26 is integrally formed with and into end section 22. See also FIGS. 4, 5 and 10. Back rest 118 is positioned adjacent channel 130 which receives end rail 12. Side surfaces 120, 122 may be generally continuous with, or meet at corners 136 with, back rest 118. In addition, back rest 118 meets top surface 124 at a top edge 198.

Tray 27 includes top and bottom surfaces 180, 181, sides 182, 184, and illustratively curved front and rear faces 186, 188. An opening 191 in tray 27 provides a handle 190 which is useful to move tray 27 between a projected, use orientation exposing seat 26 and a retracted, storage orientation. In the illustrated embodiment, surface 180 of tray 27 includes a raised perimetral edge to reduce the likelihood that liquids spilled on recessed region 183 of tray 27 will run off it.

Crib apparatus 2 includes rail assemblies 192, 194 that couple tray 27 to end unit 22. Tongues 200 of rail assemblies 192, 194 are attached to sides 182, 184 of tray 27 and grooves 196 of rail assemblies 192, 194 are attached to side walls of end unit 22 above top surface 124 as shown in FIG. 8. Tongues 200 and grooves 196 cooperate to permit the manipulation of tray 27 inwardly to its storage orientation and outwardly to its use orientation with respect to chair portion 26. In the storage orientation, tray 27 covers top edge 198. A crotch post 208 provided on the underside 181 of tray 27 reduces the likelihood that a child placed in seat 26 will slide out of chair 6.

Referring now to FIGS. 12–14, one illustrated embodiment of patient support apparatus 2 includes a canopy 231. Looking from either end of the canopy 231, it includes three sections 242, 243, 244, each of which defines slightly more than one sixth of a circle. This provides some overlap between adjacent sections 242, 243 and 243, 244. Illustratively, sections 242, 243, 244 are constructed, at least in part, from transparent or highly translucent, perhaps tinted, resins permitting observation of a child on the mattress 16 underneath canopy 231. The central section 243 includes two adjacent, arcuately shaped layers of the material defining between them an arcuate slot 246. The width of the arcuate slot 246 is such that both of the other sections 242, 244 can be pivoted upwardly and toward each other about the center of the circle of which they are sectors into the slot 246 for storage and/or access to the child in support apparatus 2 from either side of the support apparatus 2.

In another embodiment, illustrated in FIG. 15, only two sections 252, 254 are provided. Looking from either end of the canopy, each of sections 252, 254 defines slightly more than a quarter of the circle about which each is pivotable upward and toward the other to gain access to the child in support apparatus 2 from either side of the support apparatus 2. This provides some overlap between the sections 252, 254. Again, illustratively sections 252, 254 are constructed, at least in part, from transparent or highly translucent resins. In either embodiment, handles 248, 250 are provided along the lower edges of the movable sections 242, 244 (FIGS. 12–14), 252, 254 (FIG. 15) to facilitate movement.

As previously discussed, patient support apparatus 2 includes casters 28. In addition, patient support apparatus 2 includes braking and steering mechanisms (not shown). The braking and steering mechanisms facilitate movement of patient support apparatus 2, for example, by locking one or more of casters 28 against pivoting in such a way as to keep the apparatus traveling in a straight line. The braking system permits braking of one or more of casters 28, for example, to prevent or better control movement of patient support apparatus 2.

It is appreciated that although patient support apparatus 2 is described herein as being used in a hospital environment, patient support apparatus 2 may just as well be used by consumers in their homes and thus, the claims are not intended to be limited to apparatus used only in hospitals.

Furthermore, although the apparatus has been described with reference to particular means, materials and embodiments, from the foregoing description, one skilled in the art can easily ascertain the essential characteristics of the illustrative apparatus and various changes and modifications may be made to adapt the various uses and characteristics without departing from the spirit and scope of the present invention as described by the claims which follow.

What is claimed is:

1. An apparatus comprising an elongated mattress having a first end, a second end, and a pair of sides, and a crib structure including a first portion configured to support the mattress, a chair portion fixed to the first portion, a tray coupled to and movable relative to the chair portion, and a plurality of crib rail assemblies movable relative to the mattress and relative to the chair portion, the chair portion having a back rest spaced longitudinally from the first end of the mattress, the plurality of crib rail assemblies including an end rail assembly that is movable vertically in a space provided in the crib structure between the first end of the mattress and the back rest of the chair portion.

2. An apparatus comprising a mattress having a pair of ends and a pair of sides, and a crib structure including a first portion configured to support the mattress, a chair portion fixed to the first portion, a tray that is coupled to the chair portion and movable horizontally relative to the chair portion, and a crib rail assembly that is movable vertically relative to the chair portion, a portion of the crib rail assembly being movable vertically within a space provided in the crib structure between the chair portion and one of the ends of the mattress.

3. An apparatus comprising a mattress, and a crib structure including a first portion configured to support the mattress, a chair portion fixed to the first portion, and a crib rail assembly, the first portion having a powered drive assembly that is operable to move the mattress vertically relative to the chair portion, the crib rail assembly being movable vertically while the mattress is stationary, and the mattress being movable vertically by the powered drive assembly while the crib rail assembly is stationary.

4. The patient support apparatus of claim 3 wherein the powered drive assembly is powered electrically.

5. The patient support apparatus of claim 3 wherein the powered drive assembly is powered hydraulically.

6. The patient support apparatus of claim 3 wherein the powered drive assembly is powered pneumatically.

7. An apparatus comprising a mattress, and a crib structure configured to support the mattress, the crib structure including an end unit having a chair portion and a storage compartment disposed below the chair portion, and a plurality of crib rail assemblies movable relative to the chair portion and the storage compartment, a first crib rail assembly of the plurality of crib rail assemblies being movable between a raised position extending upwardly from the end unit and a lowered position in which a portion of the first crib rail assembly is situated behind the storage compartment.

8. An apparatus comprising a mattress, and a crib structure configured to support the mattress, the crib structure including a chair portion having an upwardly facing seat surface on which a child may sit and a back surface extending above the seat surface and positioned to support the child's back when the child is sitting on the seat surface, the back surface terminating at a top edge, the crib structure including a tray coupled to and movable relative to the chair portion between a first position covering the seat surface and covering the top edge and a second position uncovering at least a portion of the seat surface.

9. An apparatus comprising a mattress having a periphery and an upwardly facing surface, and a crib structure configured to support the mattress, the crib structure having a pair of spaced apart end units, each end unit having a top surface, the crib structure having a plurality of crib rail assemblies positioned about the periphery of the mattress and movable vertically relative to the mattress and relative to the end units, each of the crib rail assemblies having a top rail edge, the mattress and crib rail assemblies being movable to a position in which the top surfaces of the end units, the top edges of the crib rail assemblies, and the upwardly facing surface of the mattress are substantially coplanar.

10. An apparatus comprising a mattress movable vertically between a raised and a lowered position, the mattress having a periphery and an upwardly facing first support surface on which a child may lie while sleeping, a crib structure including a first portion configured to support the mattress, a high chair portion fixed to the first portion, and a plurality of crib rail assemblies that are positioned adjacent the mattress, the high chair portion including an upwardly facing second support surface on which the child may sit while eating, the first support surface being higher in elevation than the second support surface when the mattress is in the raised position and the first support surface being lower in elevation than the second support surface when the mattress is in the lowered position.

11. An apparatus comprising:

a mattress having a first support surface configured to support a child in a reclining position; and a crib structure having a mattress-support portion that supports the mattress and having a high chair portion fixed to the mattress-support portion, the high chair portion having a second support surface that is configured to support the child in a seated position, the crib structure having a crib rail assembly that is vertically movable between a first position and a second position, more than half of the crib rail assembly being situated within a space provided in the crib structure between the first support surface and the second support surface when the crib rail assembly is in the first position, and more than half of the crib rail assembly being situated outside the space when the crib rail assembly is in the second position.

12. The apparatus of claim 11 wherein the high chair portion includes a back rest extending upwardly from the second support surface and a portion of the space is situated behind the back rest.

13. The apparatus of claim 11 wherein the crib structure includes a pair of side rail assemblies between which the first support surface is received.

14. The apparatus of claim 13 wherein at least one of the side rail assemblies is movable vertically relative to the support surface.

15. The apparatus of claim 13 wherein a set of passageways are provided between the crib rail assembly and the pair of side rail assemblies and the passageways are configured for the passage of medical lines therethrough.

16. The apparatus of claim 13 wherein the mattress is movable vertically relative to the side rail assemblies.

17. The apparatus of claim 16 wherein the side rail assemblies and the crib rail assembly each include a top edge movable between positions above, level with, and below the first support surface.

18. The apparatus of claim 17 further including a canopy positioned adjacent the top edges of the side rail assemblies and the crib rail assembly.

19. The apparatus of claim 13 having an opening between the crib rail assembly and one of the side rail assemblies.

20. The apparatus of claim 19 wherein the opening is a vertical opening.

21. The apparatus of claim 11 wherein the high chair portion further includes a tray that is movable horizontally above the second support surface.

22. The apparatus of claim 11 wherein the first support surface is movable vertically between a first position higher in elevation than the second support surface and a second position lower in elevation than the second support surface.

23. The apparatus of claim 11 wherein the high chair portion is configured so that, when the child is in the seated position, the child faces away from the mattress.

24. A combination crib and high chair apparatus for supporting a child in a reclining position and a seated position, respectively, the apparatus comprising:

a mattress having a first end, a second end and a pair of sides, the mattress having an upwardly facing mattress surface on which the child may be supported in the reclining position;

a pair of side rails adjacent the sides;

first and second end rails, the first end rail positioned adjacent the first end of the mattress and the second end rail positioned adjacent the second end of the mattress;

a mattress-support portion configured to support the mattress;

a first end unit fixed to mattress-support portion, the first end unit having a high chair portion with a seat surface on which the child may be supported in the seated position, the first end rail being movably coupled to the first end unit; and a second end unit fixed to the mattress-support portion, the second end rail being movably coupled to the second end unit, the first and second end units each having side portions extending laterally outwardly beyond opposite sides of the mattress-support portion to define a pair of rail-receiving spaces on opposite sides of the mattress-support portion, the pair of side rails being received in the rail-receiving spaces for vertical movement.

25. The apparatus of claim 24 wherein the high chair portion of the first end unit has a backrest extending upwardly from the seat surface.

26. The apparatus of claim 24 wherein the high chair portion of the first end unit includes a pair of side walls, each extending upwardly from the seat surface.

27. The apparatus of claim 26 wherein the high chair portion of the first end unit includes a tray coupled to at least one of the side walls and positioned above the seat surface.

28. The apparatus of claim 27 wherein the tray has an underside and a crotch post extending downwardly from the underside.

29. The apparatus of claim 24 wherein the first and second end units have top surfaces and at least one of the side rails is movable to a position having a top edge of the at least one side rail substantially coplanar with the top surfaces.

30. The apparatus of claim 24 wherein the first and second end units have top surfaces and at least one of the end rails is movable to a position having a top edge of the at least one end rail substantially coplanar with the top surfaces.

31. The apparatus of claim 24 wherein the side rails and end rails have top edges, the first and second end units have top surfaces, and each of the side rails and ends rails are movable to respective positions having the top edges coplanar with the top surfaces.

32. The apparatus of claim 31 wherein each side rail and end rail includes a top edge movable among positions above, level with and below the upwardly facing mattress surface.

33. The apparatus of claim 24 wherein a slot is provided between one of the end rails and one of the side rails.

34. The apparatus of claim 24 wherein the mattress is movable relative to the first and second end units.

35. The apparatus of claim 24 wherein the mattress is movable to a height sufficient to provide convenient access by a person to the upwardly facing mattress surface without having to bend substantially at the person's waist.

36. The apparatus of claim 24 further comprising a canopy having at least one access door positioned above one of the side rails.

37. The apparatus of claim 24 wherein at least one of the end rails comprises a frame and a transparent panel coupled to the frame.

38. The apparatus of claim 24 wherein at least one of the first and second end units has a storage compartment.

39. The apparatus of claim 38 wherein the storage compartment is provided in the first end unit beneath the seat surface.

40. The apparatus of claim 39 wherein the high chair portion of the first end unit is configured so that the child faces away from the first end of the mattress when the child is in the seated position.

41. The apparatus of claim 40 wherein the seat is integrally formed with the first end section.

* * * * *